United States Patent [19]

Spehrley, Jr. et al.

[11] 4,194,666

[45] Mar. 25, 1980

[54] STAPLE CLINCHING MECHANISM

[75] Inventors: Charles W. Spehrley, Jr., Hanover; Brian F. Walsh, Etna, both of N.H.

[73] Assignee: Xerox Corporation, Stamford, Conn.

[21] Appl. No.: 919,538

[22] Filed: Jun. 26, 1978

[51] Int. Cl.[2] ..... B25C 5/02

[52] U.S. Cl. ..... 227/155

[58] Field of Search ..... 227/77, 108, 155

[56] References Cited

U.S. PATENT DOCUMENTS

| | | | |
|---|---|---|---|
| 496,634 | 5/1893 | Bradley et al. | 227/155 |
| 1,094,588 | 4/1914 | O'Brien | 227/155 |
| 1,111,114 | 9/1914 | Weber | 227/155 |
| 1,612,870 | 1/1927 | Leschhorn | 227/155 |
| 1,773,823 | 8/1930 | Polzer | 227/155 |
| 1,807,170 | 5/1931 | Peterson | 227/155 |
| 3,494,533 | 2/1970 | Green et al. | 227/155 |
| 4,032,228 | 6/1977 | Whited | 355/15 |
| 4,076,408 | 2/1978 | Reid et al. | 355/14 |

FOREIGN PATENT DOCUMENTS

| | | | |
|---|---|---|---|
| 14352 | of 1929 | Australia | 227/155 |

*Primary Examiner*—John McQuade

*Attorney, Agent, or Firm*—J. J. Ralabate; C. A. Green; H. Fleischer

[57] ABSTRACT

An apparatus in which articles are stapled to one another. A staple is driven through the article so that a portion thereof protrudes therefrom. The staple legs protruding through the articles are bent into substantial contact therewith so as to clinch the staples. In the clinched position, the staple legs are closely adjacent to one another and may be overlapping. During the clinching operation, the staple legs are guided by a groove in the surface affecting bending. Initially, the stapled leg is received in the central region of the groove. The central region of the groove has a greater cross-sectional area than the end region thereof.

12 Claims, 3 Drawing Figures

STAPLE CLINCHING MECHANISM

BACKGROUND OF THE INVENTION

This invention relates to an electrophotographic printing machine, and more particularly concerns an improved stapling apparatus for use therein.

In the process of electrophotographic printing, a photoconductive member is charged to a substantially uniform level so as to sensitize the surface thereof. Thereafter, the charged photoconductive member is exposed to a light image of an original document being reproduced. Exposure of the charged photoconductive surface discharges the charge selectively in the irradiated areas. This records an electrostatic latent image on the photoconductive surface corresponding to the informational areas contained within the original document being reproduced. After the electrostatic latent image is recorded on the photoconductive surface, the latent image is developed by bringing a developer mix into contact therewith. In this manner, toner particles are attracted from the carrier granules of the developer mix to the latent image forming a toner powder image thereon. Thereafter, the toner powder image is transferred to the copy sheet and permanently affixed thereto. This general approach was originally disclosed by Carlson in U.S. Pat. No. 2,297,691, and has been further amplified and described by many related patents in the art.

On many occasions, it is highly desirable to reproduce a set of original documents as a plurality of sets of copies. This is generally achieved by employing a recirculating document handling system in association with the electrophotographic printing machine. The recirculating document handling system is positioned on the exposure platen of the printing machine to advance successive original documents thereto. Each original document disposed on the platen is exposed and, subsequently, reproduced. After being copied, the original document is returned to the stack of original documents so that it may be re-imaged for the next successive copying cycle. In this manner, collated sets of copies or booklets may be formed. Each booklet corresponds to a set of the original documents.

Frequently, the copy sheets of a specific booklet are stapled to one another. To this end, a stapling apparatus drives a plurality of staples through the sheets of the booklet. After the staple is driven through the set of copy sheets, the staple legs are clinched by either a passive or active clinching mechanism. In order to extend the range of set thickness, bypass clinching is frequently employed. In bypass clinching, the staple legs are bent into contact with the lowermost sheet of the booklet and are closely adjacent and overlapping one another. One of the major advantages of bypass clinching is that a single staple length may be employed for a wide range of differing thickness booklets. Active clinching systems employ clinching ears which pivot to bend the staple legs during the clinching operation. Hereinbefore, bypass clinching ears exhibited fundamental flaws which made them less desirable for use in an electrophotographic printing machine. For example, if the staple leg wandered when it was being driven through the booklet, jamming frequently occured between the clinching ears and the housing. In addition, the clinching ears were frequently dimensioned so that they could not accommodate substantial misalignment between the stapler head and clinching ears. This affected staple esthetics in that the staple rolled over and the legs spread on thin sheets.

Accordingly, it is a primary object of the present invention to improve the clinching mechanism of a stapling apparatus employed in an electrophotographic printing machine.

BRIEF DESCRIPTION OF THE DRAWINGS

Other objects and advantages of the present invention will become apparent upon reading the following detailed description, and upon reference to the drawings, in which.

While the present invention will hereinafter be described in connection with a preferred embodiment thereof, it will be understood that it is not intended to limit the invention to that embodiment. On the contrary, it is intended to cover all alternatives modifications and equivalents as may be included within the spirit and scope of the invention as defined by the appended claims.

SUMMARY OF THE INVENTION

Briefly stated, and in accordance with the present invention, there is provided an apparatus for stapling articles.

Pursuant to the features of the invention, the apparatus includes means for driving a staple through the articles so that a portion of the staple legs extends therethrough. Means are provided for bending the portion of the staple legs protruding through the articles into substantial contact therewith so as to clinch the staple. The bending means comprises a pair of surfaces with each surface having a groove therein for guiding the staple leg during the bending thereof. The central region of the groove has a greater cross-sectional area than the end regions thereof. Initially, the staple leg is received in the central region of the groove.

DETAILED DESCRIPTION OF THE INVENTION

Figure 1:
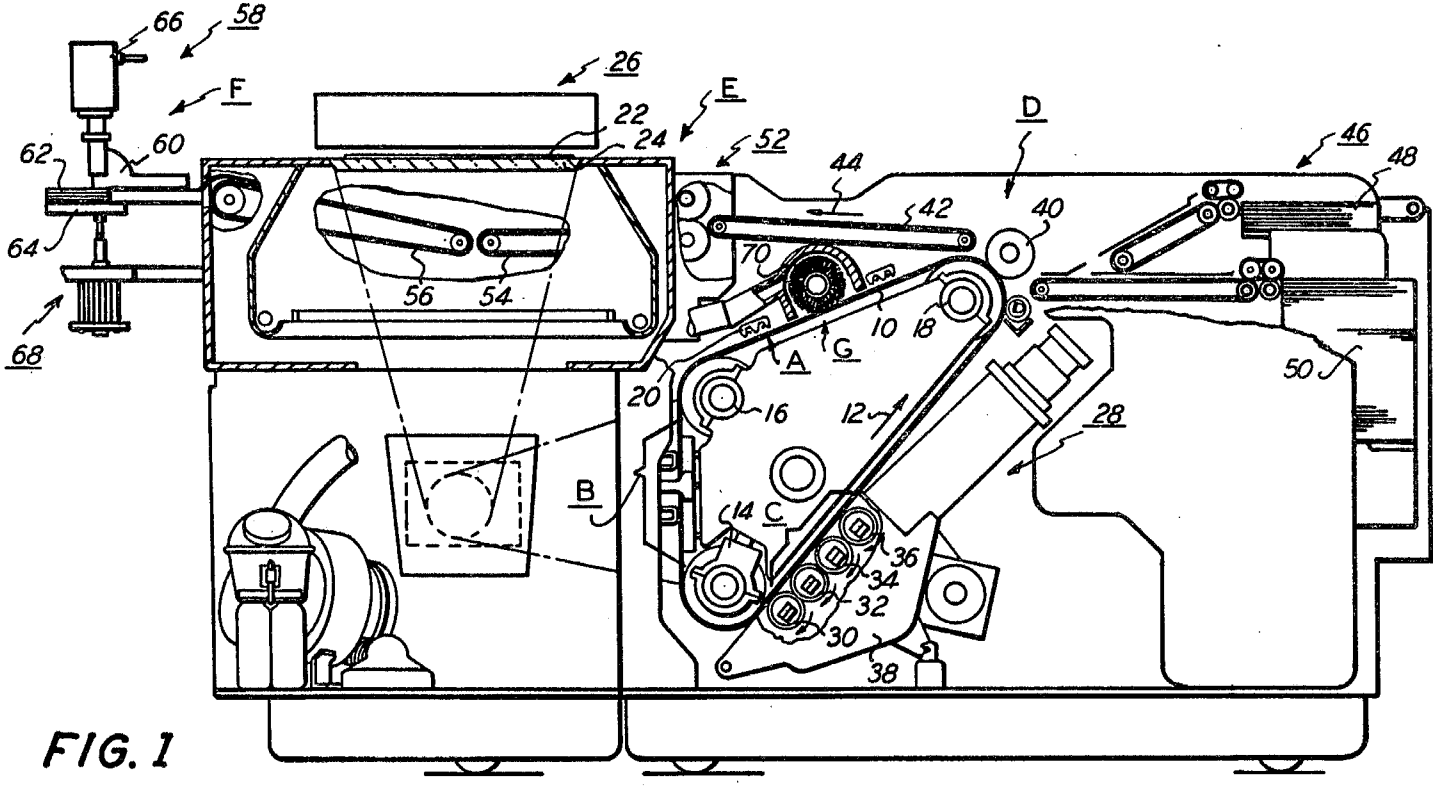
FIG. 1 is a schematic elevational view showing an electrophotographic printing machine incorporating the features of the present invention therein.

In order to more fully understand the operation of an electrophotographic printing machine incorporating the features of the present invention therein, reference is made to the drawings. In the drawings, like reference numerals have been used throughout to designate identical elements. FIG. 1 schematically illustrates the various components of an electrophotographic printing machine incorporating the improved stapling apparatus of the present invention therein. Although the stapling apparatus is particularly well adapted for use in an electrophotographic printing machine, it will become evident from the following discussion that it is equally well suited for use in a wide variety of machines, and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. By way of example, the photoconductive surface is made from a selenium alloy with the conductive substrate being made from aluminum. With continued reference to FIG. 1, belt 10 then moves in the direction of arrow 12 to advance sequentially through the various processing stations positioned about the path of movement thereof. Rollers 14, 16 and 18 support belt 10 movably. A drive mechanism, e.g., a suitable motor, is coupled to roller 14 and advances belt 10 in the direction of arrow 12. Initially, a portion of the photoconductive surface of belt 10 passes through charging station A. Preferably, charging station A includes a corona generating device, indicated generally by the reference numeral 20, which charges the photoconductive surface of belt 10 to a relatively high, substantially uniform potential. A suitable corona generating device is described in U.S. Pat. No. 2,836,725 issued to Vyverberg in 1958.

Thereafter, the charged portion of the photoconductive surface of belt 10 advances through exposure station B. Exposure station B comprises a recirculating document handling system, indicated generally by the reference numeral 26, which presents successive original documents 22, one at a time, to exposure platen 24, and returns the original documents to the stack thereof. After the original document is exposed, it is returned to the stack of original documents. A suitable recirculating document handling system is described in British Pat. No. 1,492,466, the relevant portions thereof being hereby incorporated into the present application. Original document 22 is disposed face down on platen 24 and the lamp flashes light rays thereupon. The light rays reflected from original document 22 are transmitted through the optics of the exposure system forming a light image containing the informational areas of the original document therein. The optics, e.g., a suitable lens and mirrors, project the light image onto the charged portion of the photoconductive surface of belt 10. In this manner, the charged portion of the photoconductive surface of belt 10 is selectively discharged by the light image of the original document. This records an electrostatic latent image on the photoconductive surface of belt 10 which corresponds to the informational areas contained within original document 22.

Belt 10 then advances the electrostatic latent image recorded thereon to development station C. At development station C, a developer unit 28 renders the latent image visible by depositing toner particles thereon in image configuration. Preferably, the developer unit includes a plurality of magnetic brush developer rollers 30, 32, 34 and 36 disposed in housing 38. Each developer roller advances the developer mix into contact with the electrostatic latent image recorded on the photoconductive surface of belt 10. In a system of this type, a chain-like array of developer mix extends in an outwardly direction from each developer roll to contact the electrostatic latent image rocorded on the photoconductive surface of belt 10. The latent image attracts the toner particles from the carrier granules forming a toner powder image on belt 10.

Belt 10 advances the toner powder image formed thereon to transfer station D. At transfer station D, a copy sheet is interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with a discussion of the remaining processing stations, the sheet feeding apparatus will be described briefly. The sheet feeding apparatus includes a sheet transport 46 which advances, in seriatum, successive copy sheets from stack 48, or, in lieu thereof, stack 50. The machine programming permits the operator to select the desired stack from which the copy sheet will be advanced. In this way, the selected copy sheet is advanced to transfer station D where the toner powder image adhering to the photoconductive surface of belt 10 is transferred thereto.

After the toner powder image has been transferred to the copy sheet, conveyor 42 advances the copy sheet in the direction of arrow 44 to fixing station E. Fixing station E includes a fuser assembly, indicated generally by the reference numeral 52, which comprises a heated fuser roll and a back up roll. The copy sheet having the toner powder image thereon, passes between the fuser roll and back up roll with the toner powder image contacting the heated fuser roll. This enables the toner powder image to be permanently fused or affixed to the copy sheet. After completion of the fusing operation, conveyors 54 and 56 advance the copy sheet to finishing station F.

Finishing station F comprises a stapling apparatus, indicated generally by the reference numeral 58. Stapling apparatus 58 includes a stapler head 60 which drives a staple through the stack of copy sheets 62 disposed on tray 64. Preferably, stapler head 60 is Model No. 62E manufactured by the Bostich Corporation, and is driven by an electromagnetic power device 66, such as a solenoid.

After the staple is driven through the stack of copy sheets 62, the portion of the staple legs protruding therethrough must be bent into contact with the lowermost sheet of the stack. In this manner, the staple is clinched. Preferably, the clinch is of the bypass type. In the bypass type of clinch, the staple legs are adjaent to one another and overlap one another. A clinching mechanism, indicated generally by the reference numeral 68, clinches the staple legs. Clinching mechanism 68 will be described hereinafter with reference to FIGS. 2 and 3. Prior to referring to FIG. 2, the remaining processing station disposed about belt 10 will be briefly discussed.

After the toner powder image has been transferred to the copy sheet at transfer station D, residual toner particles frequently remain adhering to belt 10. It is desirable to remove these residual toner particles from belt 10 prior to the charging thereof for the next successive imaging cycle. This may be achieved by a rotating brush 70 in contact with belt 10 at cleaning station G. Brush 70 removes the residual toner particles from belt 10. Thereafter, a vacuum blower system removes the toner particles from brush 70 and evacuates them to a storage chamber.

It is believed that the foregoing description is sufficient for purposes of the present invention to illustrate the general operation of an electrophotographic printing machine incorporating the features of the present invention therein. Referring now to the specific subject matter thereof, FIG. 2 depicts the clinching mechanism of the stapling apparatus in greater detail.

Figure 2:
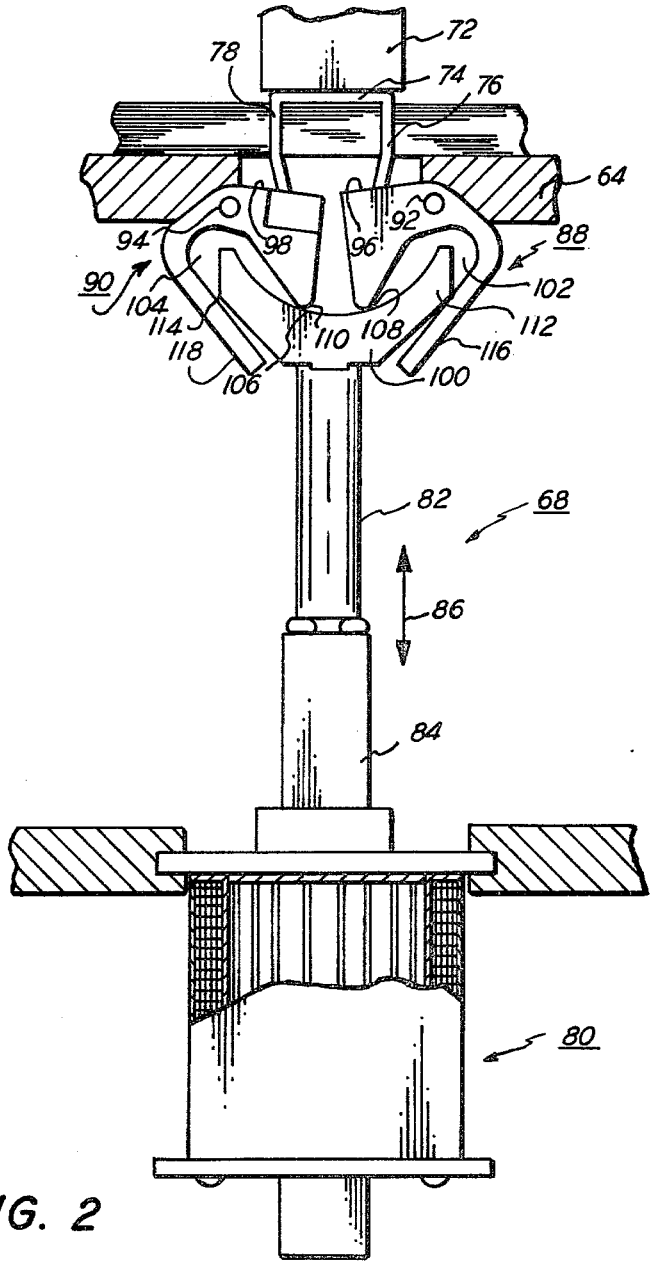
FIG. 2 is an elevational view dipicting the stapling apparatus employed in the FIG. 1 printing machines.
Figure 3:
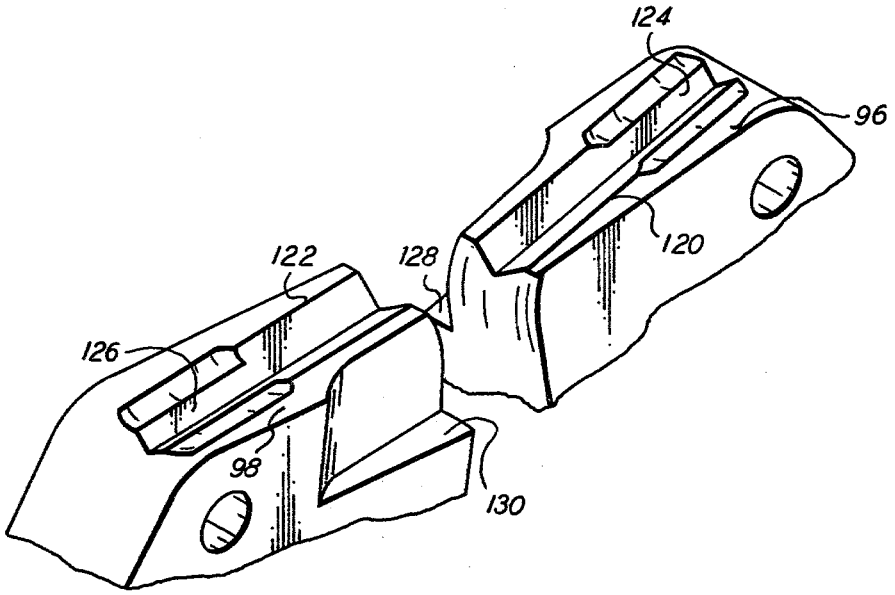
FIG. 3 is a fragmentary perspective view illustrating the clinching surface of the FIG. 2 stapling apparatus.

Turning now to FIG. 2, there is shown the detailed structure of clinching mechanism 68. As depicted thereat, stapler driver 72 of stapling head 60 drives staple 74 through the stack of copy sheets 62. Staple legs 76 and 78 protrude through the stack of copy sheets 62. Clinching mechanism 68 bends staple legs 76 and 78 into engagement with the lowermost sheet of the stack of copy sheets 62. Clinching mechanism 68 includes a solenoid 80 coupled to a clinching rod 82. Energization of solenoid 80 causes the solenoid armature 84, which is coupled to clinching rod 82, to move in the direction of arrow 86. This, in turn, causes clinching rod 82 to also move in the direction of arrow 86. Actuation of solenoid 80 causes clinching rod 82 to move in an upwardly direction so as to cause clinching ears 88 and 90 to pivot about pins 92 and 94, respectively. As clinching rod 82 moves upwardly, surfaces 96 and 98 of clinching ears 88 and 90, respectively, engage legs 76 and 78, respectively. Surfaces 96 and 98 have grooves therein for guiding the staple legs during the bending thereof. The detailed structure of surfaces 96 and 98 is shown in FIG. 3 that will be described hereinafter with reference thereto. End portion 100 of clinching rod 82, is disposed in open-ended slots 102 and 104 in clinching ears 88 and 90, respectively. Arcuate surface 106 of end portion 100 engages downwardly depending end portions 108 and 110 of clinching ears 88 and 90, respectively, during the upward movement of clinching rod 82. Preferably, arcuate surface 106 is concave. In this manner, the desired force is transmitted from solenoid 80 through clinching rod 82, and clinching ears 88 and 90 onto staple legs 76 and 78 during the bending thereof.

After staple legs 76 and 78 have been clinched or bent into contact with the lowermost sheet of stack 62, clinching ears 88 and 90 are pivoted downwardly to a position remote from the staple legs. Clinching rod 82 moves in a downwardly direction to pivot clinching ears 88 and 90 downwardly. Surfaces 112 and 114 of end portion 100 engage legs 116 and 118 of clinching ears 88 and 90, respectively, during the downward movement of clinching rod 82. In this manner, clinching ears 88 and 90 are pivoted downwardly to a position remote from staple legs 76 and 78. After the clinching ears have been retracted to a position remote from the staple legs, clinching mechanism 68 is ready to be actuated for the next successive clinching operation.

Turning now to FIG. 3, the detailed structure of surfaces 96 and 98 of clinching ears 88, and 90, respectively, will be described. As shown in FIG. 3, surfaces 96 and 98 include grooves 120 and 122, respectively. Preferably, grooves 120 and 122 are V-shaped slots. The central portions 124 and 126 of grooves 120 and 122, respectively, have a greater cross-sectional area than the end portion thereof. This provides a greater target area for staple legs 76 and 78, respectively. The central portions 124 and 126 are wider than V-shaped slots 120 and 122. As shown in FIG. 3, the central portions 124 and 126 include the respective V-shaped slots 120 and 122 as well as arcuate regions extending outwardly from the V-shaped slots and intersecting surfaces 96 and 98 of the respective clinching ears so as to provide a wider target area. Although slots 120 and 122 are shown as being V-shaped, they also could be elliptical. In operation, staple legs 76 and 78 initially engage central portions 124 and 126 of grooves 120 and 122, respectively. Thereafter, as the clinching ears 88 and 90 continue to move upwardly, staple legs 76 and 78 are bent inwardly and are guided by the end regions of grooves 120 and 122. As staple legs 76 and 78 bend, the end portions thereof may extend beyond their respective clinching surfaces 96 and 98. Clinching ears 88 and 90 are opposed from one another and do not overlap if the stack of copy sheets being stapled is thin, the end portion of staple leg 78 may engage clinching ear 88 while the end portion of staple leg 76 may engage clinching ear 90. This would result in a bent or distorted staple leg. To prevent the foregoing from occuring, surface 96 includes a chamfered portion 128 opposed from groove 126. Chamfered portion 128 defines a recess in clinching ear 88 (FIG. 2) opposed from the longitudinal axis of groove 122 in clinching ear 90 (FIG. 2). During the clinching operation, the staple leg being bent by clinching ear 90 will have a portion extending beyond groove 122 and into the recess formed by chamfered portion 128 of clinching ear 88. This permits the end portion of staple leg 78 to clear clinching ear 88. Similarly, surface 98 includes a chamfered portion 130 opposed from groove 120. Chamfered portion 130 defines a recess in clinching ear 90 (FIG. 2) opposed from the longitudinal axis of groove 120 in clinching ear 88 (FIG. 2). During the clinching operation, the staple leg being bent by clinching ear 88 will have a portion thereof extending beyond groove 120 into the recess formed by chamfered portion 130 in clinching ear 90. This enables staple leg 76 to clear clinching ear 90. In this manner, staple jams are prevented. While the invention has been described in connection with chamfered portions 128 and 130 being obliquely slopping planes to define recesses in the respective clinching ears, one skilled in the art will appreciate that the invention is not necessarily so limited and any type of suitable recess sufficient to define a space for the outwardly extending portions of the staple legs is satisfactory.

In recapitulation, it is evident that the improved clinching ears of the clinching mechanism reduces the potentiality for staple jams while improving the reliability of the stapling apparatus. The present clinching apparatus permits staple legs of sufficient length to accommodate large variations of stack size to be employed. In addition, the target area for the staple legs at initiation of clinching is increased so as to permit greater staple leg wander during the driving operation without interfering with the clinching operation or producing deformed or distorted staples.

It is, therefore, evident that there has been provided, in accordance with the present invention, a stapling apparatus that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and scope of the appended claims.

What is claimed is:

1. An apparatus for stapling articles, including:

means for driving a staple through the articles so that a portion of the staple legs extends therethrough; and means for bending the portions of the staple legs protruding through the articles into substantial contact therewith so as to clinch the staple, said bending means comprising a pair of pivotably mounted clinching ears, each of said clinching ears having a surface with a groove therein for guiding each of the staple legs during the bending thereof with the central region of each of the grooves having a greater cross sectional area than the end regions thereof and the central regions of each of the grooves being located to receive each of the staple legs at the initiation of the clinching operation, and each of said clinching ears includes a a recessed portion opposed from the groove of the other of said clinching ears so as to provide for the portion of each of the staple legs extending beyond the groove therein.

2. An apparatus as recited in claim 1, wherein said bending means includes a clinching rod having an arcuate end portion in contact with the said clinching ears so that translation of said clinching rod pivots said clinching ears so as to bend the staple legs into substantial contact with the article, thereby clinching the staple.

3. An apparatus as recited in claim 2, wherein the arcuate portion of said clinching rod is concave.

4. An apparatus as recited in claim 2, wherein said clinching ears include open ended slots with the arcuate portion of said clinching rod being interfit in the slot of each of said clinching ears so that movement of said clinching rod in one direction pivots said clinching ears from a position remote from the staple legs to a position wherein the central region of each groove receives a staple leg and said clinching ears bend the staple legs to clinch the staple, and movement of said clinching rod in the opposed direction pivots said clinching ears to the position remote from the staple legs.

5. An apparatus as recited in claim 4, wherein said bending means includes means for moving said clinching rod.

6. An apparatus as recited in claim 5, wherein said moving means includes a solenoid.

7. a reproducing machine of the type having a stapling apparatus for stapling a plurality of copies to each other, wherein the improved stapling apparatus includes:

means for driving a staple through the plurality of copies so that a portion of the staple legs extends therethrough; and means for bending the portion of the staple legs protruding through the plurality of copies into substantial contact therewith so as to clinch the staple, said bending means comprising a pair of pivotably mounted clinching ears, each of said clinching ears having a surface with a groove therein for guiding each of the staple legs during the bending thereof with the central region of each of the grooves having a greater cross sectional area than the end regions thereof and the central regions of each of the grooves being located to receive each of the staple legs at the initiation of the clinching operation, and each of said clinching ears includes a recessed portion opposed from the groove of the other of said clinching ears so as to provide space for the portion of each of the staple legs extending beyond the groove therein.

8. A reproducing machine as recited in claim 7 wherein said bending means includes a clinching rod having an arcuate end portion in contact with said clinching ears so that translation of said clinching rod pivots said clinching ears so as to bend the staple legs into substantial contact with the plurality of copy sheets, thereby clinching the staple.

9. A reproducing machine as recited in claim 8, wherein the arcuate portion of said clinching rod is concave.

10. A reproducing machine as recited in claim 2, wherein said clinching ears include open ended slots with the arcuate portion of said clinching rod being interfit in the slot of each of said clinching ears so that movement of said clinching rod in one direction pivots said clinching ears from a position remote from the staple legs to a position wherein the central region of each groove receives a staple leg and said clinching ears bend the staple legs to clinch the staples and movement of said clinching rod in the opposed direction pivots said clinching ears to the position remote from the staple legs.

11. A reproducing machine as recited in claim 10, wherein said beinding means includes means for moving said clinching rod.

12. A reproducing machine as recited in claim 11, wherein said moving means includes a solenoid.

* * * * *